United States Patent [19]

Manookian, Jr.

[11] 4,136,650

[45] Jan. 30, 1979

[54] CRANKCASE OIL VAPOR RECOVERY SYSTEM

[76] Inventor: Arman Manookian, Jr., 2875 Terrell Ave., Oceanside, N.Y. 11572

[21] Appl. No.: 773,617

[22] Filed: Mar. 2, 1977

[51] Int. Cl.[2] ..... F02M 25/06

[52] U.S. Cl. ..... 123/119 B

[58] Field of Search ..... 123/119 B

[56] References Cited

U.S. PATENT DOCUMENTS

| | | | |
|---|---|---|---|
| 2,716,398 | 8/1955 | McMullen | 123/119 B |
| 3,088,447 | 5/1963 | Henderson | 123/119 B |
| 3,092,091 | 6/1963 | Bosley | 123/119 B |
| 3,125,083 | 3/1964 | Scribner | 123/119 B |
| 3,166,062 | 1/1965 | Yerman | 123/119 B |
| 3,179,097 | 4/1965 | Jackson | 123/119 B |
| 3,209,738 | 10/1965 | Powers | 123/119 B |
| 3,246,639 | 4/1966 | Oliver | 123/119 B |
| 3,463,132 | 8/1969 | Krieck | 123/119 B |
| 3,509,967 | 5/1970 | Ballard | 123/119 B |
| 3,542,002 | 11/1970 | Miles | 123/119 B |

*Primary Examiner*—Wendell E. Burns
*Attorney, Agent, or Firm*—Bauer & Amer

[57] ABSTRACT

Air circulated in the interior of a gasoline engine becomes contaminated therein with gasoline and oil vapors trapped in the crankcase. This contaminated air is then fed, by means of intake manifold vacuum, to the cylinder for combustion. By passing the contaminated air through a filtering means prior to combustion, the oil vapors are removed, providing longer spark plug life and improved engine performance and reduced oil and grease deposits in the intake manifold. A drain in the filter returns the oil collected to the crankcase for reuse.

4 Claims, 5 Drawing Figures

CRANKCASE OIL VAPOR RECOVERY SYSTEM

FIELD OF THE INVENTION

This invention relates to a method and apparatus for the separation from contaminated air of impurities intermixed therewith prior to its use for combustion in a gasoline powered engine.

BACKGROUND OF THE INVENTION

In a typical gasoline-powered automobile engine, a carburetor mixes controlled quantities of filtered air and fuel and feeds the resultant mixture to an intake manifold, from which it is distributed to the cylinder for combustion. The by-products of this combustion are then vented, through emission control devices, to the atmosphere. Engine designers and manufactures have long been aware that as the fuel-air mixture is compressed by the piston in a particular cylinder, a small quantity of the mixture slips by the piston sealing rings, escaping into the crankcase, or interior portion, of the engine block.

Until the early 1960's these blow-by vapors and other contaminents trapped in the crankcase, such as oil vapors emitted by heated engine-lubricating oil, were simply vented into the atmosphere through small ports on the engine block. Since that time, however, engines have been equipped with positive crankcase ventilation (PCV). In this system, a stream of fresh air is directed into the engine interior wherein it circulates, picking up the vapors therein. The contaminated flowing air then leaves the engine through a PCV valve and is conducted by conduit means to the intake manifold, wherein it mixes with the fuel-air mixture provided by the carburetor and is distributed to the cylinders for combustion. Non-combustible components are released, through emission control devices, to the atmosphere. Vacuum in the intake manifold maintains the flow of air through the system.

SUMMARY OF THE INVENTION

It has been discovered that oil and other contaminents mixing with the circulating air in the crankcase and, thereafter, reaching the intake manifold and combustion cylinders, has a number of undesirable and deleterious effects on engine performance, including fouling of spark plugs through accumulation thereon of non-combustible residues, increased exhaust emissions due to the presence of unburned vapors, and decreased gas mileage as a result of incomplete combustion and the necessity of enriching the fuel-air mixture to off-set the loss of power therefrom. It has, further, been discovered that by employing a separator in the path of the contaminated air flow downstream of its exiting the engine block and upstream of the intake manifold, these problems of engine operation are reduced significantly. A filter having an inlet port and an outlet port is connected by hoses to the output of the PCV valve and the intake manifold, respectively. A filtering material of wool or felt is employed, although any material which will pass the air and separate therefrom liquid and solid contaminents is sufficient. In a preferred embodiment of the invention, oil is collected in the bottom of the filter and drained, during periods of non-operation of the engine, through an air-check valve into the crankcase, where it remixes with the lubricating oil from which it came. Thus, yet another advantage of the invention is a reduction in oil consumption.

OBJECTS OF THE INVENTION

It is, therefore, an object of the present invention to provide a method and apparatus for the cleansing of positive crankcase ventilation vapors of a gasoline engine prior to feeding it to the cylinders for combustion.

Another object of the present invention is to provide a method and apparatus to recover oil from the positive crankcase ventilation vapors of a gasoline engine and return the recovered oil to the crankcase.

It is a further object of the present invention to provide a method and apparatus for the cleansing of positive crankcase ventilation vapors of a gasoline engine prior to feeding it to the cylinders for combustion that is contructed of inexpensive, commercially available components and is easily installed on an existing engine.

Other objects and purposes of the present invention will become apparent from the following detailed description considered in connection with the accompanying drawings. It is to be understood, however, that the drawings are designed for purposes of illustration only and not as a definition of the limits of the invention for which reference should be made to the appending claims.

BRIEF DESCRIPTION OF THE DRAWINGS

In the drawings wherein the same reference numeral denotes the same element throughout the several views.

DETAILED DESCRIPTION OF THE DRAWINGS

Figure 1:
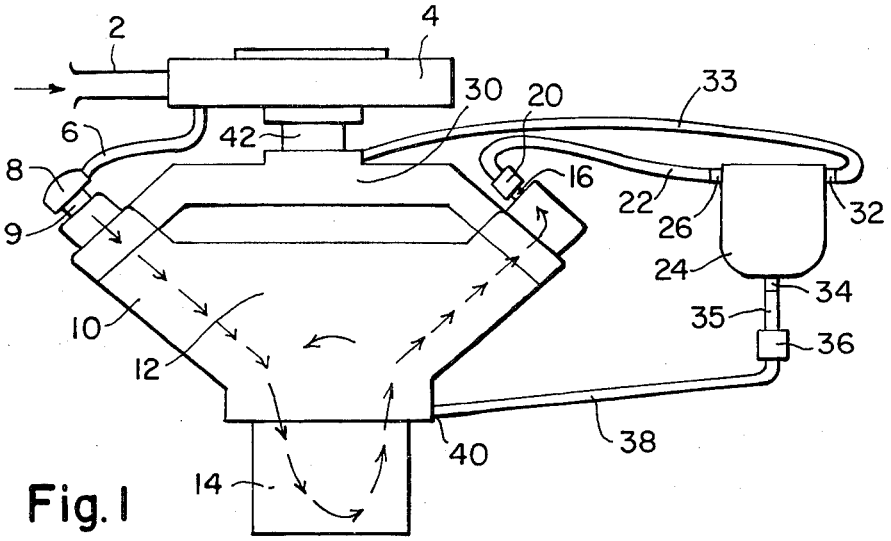
FIG. 1 is a schematic showing of a typical V-type engine incorporating the filter means of the present invention.

In detail now and turning to FIG. 1 there is shown a partial cross-section of a typical V-type gasoline-powered engine embodying the present invention. Air flows into the air filter 4 through the intake duct 2. Some of this air is directed via a conduit 6 through an engine aperture 9 to the interior 12 of the engine block 10, passing first through a breather cap 8. An oil pan 14 holds a volume of lubricating oil that is circulated throughout engine interior, or crankcase, 12. As the engine runs, the lubricating oil heats and emits oil vapors, which are trapped in crankcase 12. Additionally, vapors consisting of an air-fuel mixture escape into crankcase 12 from the combustion chambers, mixing therein with trapped oil vapors. As shown by the arrows in FIG. 1, fresh air entering crankcase 12 at aperture 9 circulates therein, mixing with the trapped vapors, exiting engine block 10 at an aperture 16, and passing thence through positive crankcase ventilating (PCV) valve 20. The direction of flow is defined by a vacuum present in the intake manifold 30 whenever the engine is running, which vacuum pulls the air through the system. The mixture of air and crankcase vapors is channeled via a conduit 22 from PCV valve 20 to inlet port 26 of oil recovery filter 24.

Figure 2:
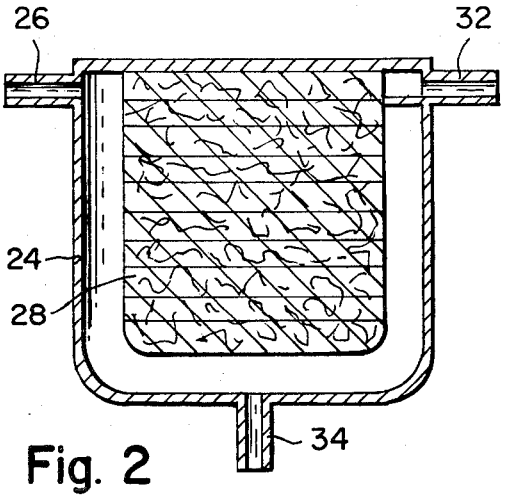
FIG. 2 is a vertical cross-section of a typical filter device utilized in the invention.
Figure 5:
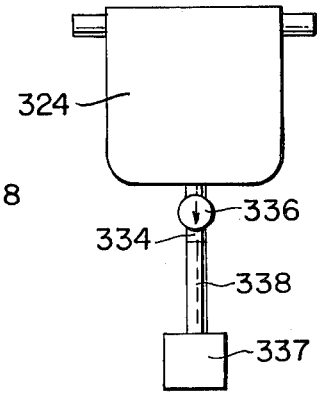
FIG. 5 is a schematic showing of yet another embodiment of the filter device with a collection container attached thereto.

In FIG. 2, an embodiment of an oil recovery filter 24, the input flow at portal 26 passes through filter element 28 wherein the condensed oil vapors are separated from the flow. The oil residue drips to the bottom of filter 24 and drains from port 34 through a conduit 35 to a vertical air-check valve 36. Valve 36 is a commercially available air-check valve, such as Circle Seal #2259B, ¼ inch Load Genie, modified to reduce the tension on its plunger. Valve 36 remains fully closed during engine-running, vacuum-producing periods in order to maintain a constant vacuum in the engine, When the engine ceases operation, valve 36 opens, permitting oil recovered by filter 24 to return through conduit 38 and aperture 40 to the crankcase 12 and oil pan 14. Since this oil return occurs only when the engine is not operating and, therefore, not producing a vacuum, gravitational force is utilized to accomplish the return flow. As depicted in FIG. 5, valve 336 could alternatively be located in drainage port 334 of filter 324, obviating the necessity for a conduit between the filter and the valve.

The filtered air flow exits filter 24 at outlet port 32, drawn through conduit 33 to intake manifold 30 where it mixes with a fuel-air mixture fed to intake manifold 30 by the carburetor 42. The fuel-air mixture is then distributed to the cylinders for combustion.

Figure 3:
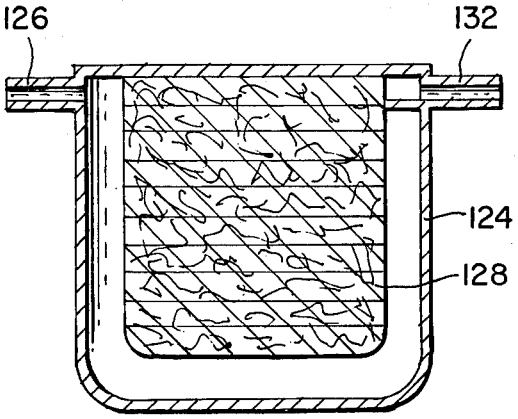
FIG. 3 is a vertical cross-section of another embodiment of a typical filter device utilized in the invention.

FIG. 3 shows an alternate embodiment of the oil recovery filter, designated as 124. In this embodiment, the contaminated air enters at inlet port 126, passes through filter element 128, and exits less the contaminating oil at portal 132. Oil is collected at the bottom of filter 124 and remains there until the filter is discarded at the end of a predetermined period. The length of this period depends on the size of the filter casing employed and mileage driven during the filter's use. This alternate embodiment does not require vertical air-check valve 36, aperture 40, or conduits 35 and 38 of FIG. 1, and is particularly suited to use on an engine manufactured without the device of this invention, where installation of this embodiment would not require the addition of crankcase aperture 40 of FIG. 1.

Figure 4:
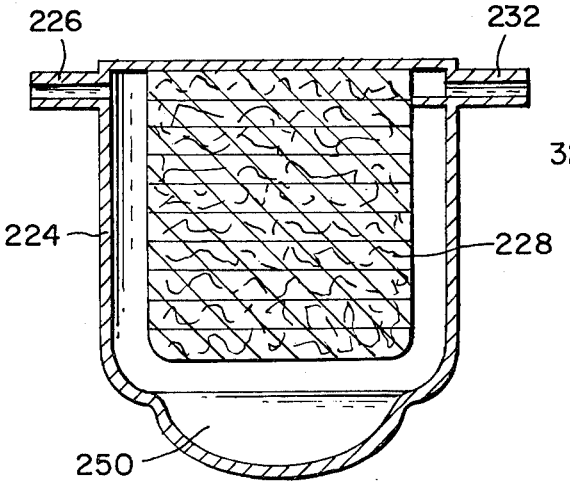
FIG. 4 is a vertical cross-section of still another embodiment of a typical filter device utilized in the invention.

Another embodiment of the separator of this invention is shown in FIG. 4. Contaminated air entering at port 226 passes through filter material 228 and thence exits at port 232. The contaminents separated from the air flow therein are collected in the base depression, or sump, 250 of filter 224. This embodiment provides for longer effective filter life over the embodiment of FIG. 3 since it can, by virtue of sump 250, collect a greater amount of recovered contaminents therein prior to necessary replacement.

Another alternative, shown in FIG. 5, employs a separate container 337, connected by conduit means 338, to collect recovered contaminents from the filter. Container 337 can be mounted in the engine compartment in any convenient manner known to skilled mechanics, and can be emptied or replaced as necessary.

While only a few embodiments of the present invention have been shown and described, it is to be understood that many changes and modifications may be made hereto without departing from the spirit and scope hereof. It is the intention, therefore, to be limited only as indicated by the scope of the claims appended hereto.

What is claimed is:

1. In a combustion-type engine through which lubricating oil flows and having an oil sump, a source of input air directed to the interior of the engine whereat the air becomes mixed with oil, a source of vacuum, by which said input air introduced into the engine is directed to the interior thereof for mixture with the lubricating oil, an air exhaust means communicating with the interior of said engine, conduit means connecting said air exhaust means with said source of vacuum, means in series connection with said conduit for filtering the oil-mixed air to separate from the air oil mixed therewith, means to collect the filtered oil, said filter means comprising a bounded chamber defining a flow passage and having defined therein an inlet aperture connected by said conduit means to said air exhaust means and an outlet aperture connected by said conduit means to the source of vacuum at opposite ends of said flow passage, a drainage port for enabling removal from said bounded chamber of at least some of the oil separated from the oil-mixed air, and a filtering material located in the flow passage between the inlet and outlet apertures such that air entering said bounded chamber at the inlet aperture must pass through said filtering material to exit said bounded chamber through the outlet aperture, said filtering material being favorably-permeable to air but offering resistance to the through-flow of oil, and valve means in series connection with said drainage port to close the same against through-flow of oil during periods of engine operation, said collecting means being in series connection with said drainage port and valve means to collect the filtered oil passing in series through said drainage port and valve means.

2. The combination of claim 1, including a Positive Crankcase Ventilating (PCV) valve located at said air exhaust means.

3. The combination of claim 1, wherein:

said collecting means constitutes the interior of the engine through an aperture defined therein.

4. In an engine having an intake manifold, a crankcase and lubricating oil, and a circulation of air therein, the method of cleansing the circulated air that has been contaminated prior to combustion, the steps including:

exiting the circulated contaminated air from the engine crankcase, filtering the contaminated air, returning the filtered air to the intake manifold for combustion, returning the liquid by-product of said filtering to the engine crankcase, and closing a valve during period of engine operation to prevent the return of the liquid by-products to the engine crankcase while the engine is operating.

* * * * *